US006434997B1

(12) United States Patent
Ellis

(10) Patent No.: US 6,434,997 B1
(45) Date of Patent: Aug. 20, 2002

(54) METHOD AND APPARATUS FOR METAL CONTAINER MANUFACTURE

(75) Inventor: Darren James Ellis, Castleford (GB)

(73) Assignee: Meltog Ltd., Birstall (GB)

( * ) Notice: Subject to any disclaimer, the term of this patent is extended or adjusted under 35 U.S.C. 154(b) by 0 days.

(21) Appl. No.: 09/684,078

(22) Filed: Oct. 7, 2000

(30) Foreign Application Priority Data

Oct. 8, 1999 (GB) ..... 9923773

(51) Int. Cl.[7] ..... B21D 17/02
(52) U.S. Cl. ..... 72/353.6; 72/393
(58) Field of Search ..... 72/353.4, 353.6, 72/354.2, 393; 413/69, 73

(56) References Cited

U.S. PATENT DOCUMENTS

| | | | | |
|---|---|---|---|---|
| 1,355,351 A | * | 10/1920 | Norquist | 72/393 |
| 1,823,047 A | * | 9/1931 | Hothersall | 72/393 |
| 2,198,873 A | * | 4/1940 | Hinsdale | 72/353.6 |
| 2,435,306 A | * | 2/1948 | Grotnes | 72/393 |

* cited by examiner

*Primary Examiner*—Lowell A. Larson
(74) *Attorney, Agent, or Firm*—Bell, Boyd & Lloyd LLC

(57) ABSTRACT

A method and apparatus (2) for providing at least a bead (4) on a side wall portion (10) of a metal container (8). The apparatus includes a mandrel (16) over which side wall portions (10) of the container are disposed. The mandrel (16) has reaction members (20) with reaction surfaces for supporting the side wall portion internally and a plurality of forming members (18) surrounding the mandrel having forming surfaces being substantially parallel with the reaction surfaces but separated therefrom to define a gap between the surfaces which receives the side wall portion (10). The reaction members (20) and forming members (18) are capable of displacement towards and away from one another such that the gap between the reaction surfaces and forming surfaces can effectively expand and contract. The reaction surfaces and forming surfaces are provided with complementary formations thereon to deform the side wall portion therebetween and form a bead (4) therein. The reaction members (20) and the forming members (18) are moved back and forth by virtue of cam means particular to each reaction member and forming member and the cam means are provided on an actuating member (26) having a linear reciprocal motion parallel with the axis of the mandrel (16). A curl (6) can also be formed on the container using curl forming means (44) which are also provided on the actuating member (26).

15 Claims, 1 Drawing Sheet

METHOD AND APPARATUS FOR METAL CONTAINER MANUFACTURE

Figure 1:
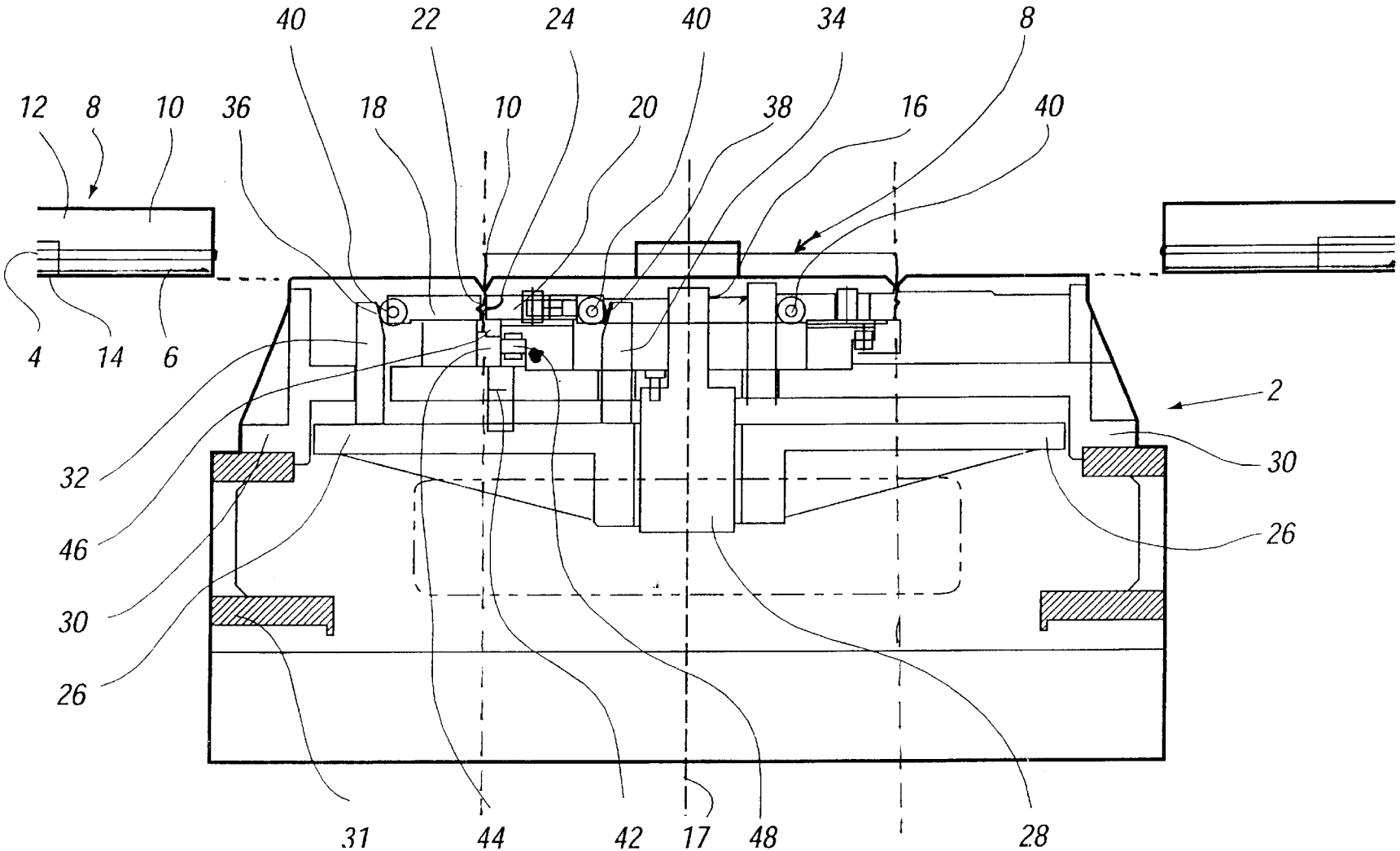

The invention relates to an improved method and apparatus for metal container manufacture, and more specifically to apparatus and a method for providing a bead proximate the upper peripheral edge of a tin box.

Metal containers with lids are provided with a bead adjacent an upper edge of the container to enable the lid to frictionally engage therewith and/or to prevent a corresponding bead provided on the edge of a peripheral skirt of a lid from easily sliding off the outer surface of the container. The bead is required to be of the same dimensions around the entire upper edge of the container so that the lid has equal contact along the same. This ensures a good fit of the lid with the container and also makes the interior of the container as airtight as possible. This is particularly important when the container is being used to store food products or dried products where the ingress of air and moisture needs to be limited.

Metal containers are also provided with a, usually inwardly disposed, curl on the uppermost edge of the sidewalls. This provides the container with a neat and safe finish to the edge, which is both appealing to the eye and prevents a potentially sharp edge being exposed to a user of the container.

A conventional method of providing the bead and curl typically involves three steps. Firstly, an end-less tube having the cross-section of the completed container is placed on a mandrel and clamped such that the mandrel is internally disposed on the walls of the tube. The mandrel is comprised of a plurality of wedges which can slide relative to one another to effect the expansion of said mandrel, and on the external surface thereof there is provided a bead-like protrusion. Secondly, a forming tool also comprised of a plurality of inwardly disposed wedges capable of relative motion with respect to one another such that forming surfaces thereof can approach and retreat from the mandrel disposed internally of the container, hereinafter referred to as the inner mandrel. The surface of the forming tool is commonly provided with a bead-like groove into which the material of the container can be deformed by the action of the bead-like protrusion on the inner mandrel. The inward and outward actuation of the surfaces of said forming tool may be effected by angular displacement of a further component acting around the said forming tool.

In use, the inner mandrel is expanded outwardly against the side walls of the container with the forming tool being simultaneously actuated such that the surfaces thereof approach and are brought to bear against the outer surfaces of the side walls of the container. The bead-like protrusion on the surface of the inner mandrel is slightly displaced inwardly from the free edge of the tube and in the region where the bead-like protrusion contacts the side walls, the material is plastically deformed into the bead-like groove provided in the surface of the forming tool. Finally, a series of pins are raised which drive a ring component, having a groove cut therein of the same shape in plan as that of the cross-sectional shape of the container, upwardly such that an already partially formed curl known as a pre-curl on the uppermost edge of the sidewall of the tin box is received in said groove. The profile of the groove and the extent of the upward motion of the ring component are such that the pre-curl is further deformed within the groove to create a complete curl.

A disadvantage of the conventional method is that the various portions of the forming tool have to be accurately positioned to ensure equal clamping pressure of the tin box side wall between the mandrel during the formation of the bead-like protrusion therein.

This ensures that the bead is of the same general profile around the entire surface of the tin enabling a good fit with the lid. Any imbalance in the clamping force or imprecise alignment of the forming tool and mandrel can result in imperfect manufacture, in particular by imparting an undesirable outward flare of the side wall from one end to the other and along a portion or the whole of said side wall. The precision required is frequently either not achieved or is lost during regular use of the apparatus. In severe incidences of the problem, the dimensions of the lids for the containers are then required to be enlarged to allow for greater clearance and thus permit the depending annular skirt of the lid to pass completely over both the uppermost curled edge of the box and over the bead.

A further disadvantage is the number of components which are required to be independently actuated. Specifically, the mandrel disposed within the tin box is usually expanded immediately prior to the formation of the bead by the actuation of components which move axially parallel with the axis of the box, whereas the forming tool or tools are actuated by a rotationally moving component around the said forming tool and are required to be moved towards and away from said inner mandrel in a direction perpendicular to the axis of said box. This problem serves to increase the size and complexity of the apparatus.

It is therefore an object of the present invention is to provide a more efficient method and apparatus for manufacturing of a bead and curl on a metal container which overcomes the above mentioned problems.

It is a further object of the invention to provide an apparatus which provides both bead and curl by virtue of the driven linear actuation of a single component.

According to a first aspect of the present invention there is provided an apparatus for providing at least a bead on a side wall portion of a metal container, said apparatus comprising a mandrel over which said side wall portion is disposed, said mandrel having reaction members with reaction surfaces for supporting the side wall portion internally, the apparatus further comprising a plurality of forming members surrounding the mandrel having forming surfaces being substantially parallel with the reaction surfaces but separated therefrom to define a gap between said surfaces which receives the said side wall portion, said reaction members and forming members being capable of displacement towards and away from one another such that the gap between the reaction surfaces and the forming surfaces can effectively expand and contact, said reaction surfaces and said forming surfaces being provided with complementary formations thereon to deform the side wall portion therebetween and form a bead therein, characterized in that the reaction members and the forming members are moved back and forth by virtue of cam means particular to each reaction member and forming member, said cam means being provided on an actuating member having a linear reciprocal motion parallel with the axis of the mandrel.

Preferably the cam means comprise a plurality of pins or plates standing proud of one surface of the actuating member having inclined cam surfaces at their extremities on which cams rotationally mounted on the reaction and forming members can travel.

Preferably the inclination and disposition of the cam means which cause linear translation of the reaction members and those cam means which cause linear translation of the forming members can be different so that the translation of either reaction or forming members can be began before the other or at the same time, and also the velocity and/or acceleration of said members can be predeterminedly controlled.

Preferably the reaction members and the forming members are springingly biased against the cam means to ensure that as the actuating plate is moved axially away from the mandrel, the said reaction members and forming members automatically move away from one another. This feature also facilitates the loading and unloading of the side wall portion of a container into and from the machine.

It is to be mentioned however that the apparatus according to the invention may only provide a bead, and it is not essential to the invention that both bead and curl be created consecutively, although this is preferable.

It is most preferable that the actuating plate is further provided with or communicates with curl forming means disposed around the periphery of said side wall portion and underneath the same.

Preferably the motion of the actuating plate causes corresponding motion of the curl forming means relative to the peripheral edge of the side wall portion and in the same plane, and preferably this relative motion is achieved as the actuating plate approaches its maximum displacement from the mean about which it reciprocates.

Preferably the curl forming means and/or the actuating plate are provided with stop means to limit the relative motion of the side wall portion and said curl forming means and thereby limit the size of the finished curl.

Preferably the peripheral edge of the side wall portion is initially provided with a pre-curl prior to the insertion of said portion into the apparatus.

According to a second aspect of the present invention there is provided a method of manufacturing a bead and curl on a side wall portion of a metal container, said method comprising the steps of disposing said side wall portion around a mandrel, clamping said sidewalls of said container between reaction surfaces of reaction members provided on the mandrel and forming surfaces substantially parallel with the reaction surfaces and provided on forming members suitably arranged around the reaction surfaces to define a gap of the same general shape as the cross-sectional shape of the container, said reaction surfaces and said forming surfaces having complementary formations and being capable of being displaced towards and away from one another, forming a bead in said sidewall portion by compressing the said side wall portion between said reaction surfaces and said forming surfaces, and subsequently causing curl forming means to move relative to the side wall portion thereby forming a curl, characterised in that the displacement of the reaction members and forming members is laterally outwardly and inwardly of the mandrel whereas the relative motion between the curl forming means and the side wall portion of the container is axially of the mandrel, and both motions are caused by the motion of an actuating plate translating back and forth in the same general direction as the axis of the mandrel.

Preferably said actuating plate is slidably located on a spindle. In addition, the actuating plate can be spring biased on the spindle.

During a cycle of operation of the apparatus, the actuating plate rises up the spindle and thus the cam means, i.e. pins or plates also move vertically upwards. The inclined cam surfaces on said pins or plates cause lateral displacement of the reaction members and subsequently the forming members, whereafter continued upward motion of the actuating plate causes relative movement between the side wall portion and curl forming means. After the bead and curl have been completed, the actuating plate retracts, thus lowering the pins which in turn releases the formed curl from the curl forming means and subsequently the side wall portion from between the reaction and forming surfaces.

An advantage of the present invention is that the bead and curl operation is performed in a single vertical motion rather than three separate steps as in the prior art. The reduction in the number of steps of the process increases the efficiency of the same.

An embodiment of the present invention will now be described with reference to the accompanying Figure wherein:

FIG. 1 is a cross-section of an apparatus for the manufacture of a bead and curl on a metal container.

Referring firstly to FIG. 1, there is illustrated an apparatus 2 for the manufacture of a bead 4 and curl 6 on a metal container 8.

The metal container 8 has sidewalls 10, a base 12 and an upper edge 14. Prior to operation of the apparatus 2, the upper edge 14 is ideally provided with a pre-curl.

The metal container 8 is placed over a mandrel 16 having a central axis 17 with the upper edge 14 lowermost. The sidewalls 10 are placed between first and second opposing jaw members 18 and 20 respectively.

The first jaw member 18 is outwardly biased from the apparatus 2 and has a bead recess portion 22. The second jaw member 20 is inwardly biased of the apparatus 2 and has a correspondingly located bead protrusion portion 24.

An actuating plate 26 is slidably located on a spindle 28, and the spindle is held in position by support means 30. The entire arrangement is mounted in a frame 31 which forms an integral part of the apparatus 2. The actuating plate 26 has first and second members, 32 and 34, which communicate with first and second opposing jaw members, 18 and 20 respectively. It is to be mentioned that the actuating plate will have a plurality of said members to cause actuation of a plurality of jaw members, being either jaw members suitably disposed within the mandrel or jaw members which are arranged around those connected within the mandrel to define a gap between same into which a side wall portion of a container is placed.

First and second members 32 and 34 have inclined cam surfaces 36 and 38 on which roller cams 40, coupled to first and second jaw members 18, 20, can move.

The actuating plate also has third members 42 which communicate with curl forming means 44.

In operation of apparatus 2, actuating plate 26 undergoes a first vertical motion as part of a reciprocating motion, which results in upwards motion of first and second members 32 and 34. Vertical motion of the members 32 and 34 cause the cam rollers 40 to roll over the inclined cam surfaces 36 and 38, thereby resulting in conversion of the vertical motion of the actuating plate into horizontal motion of the opposing jaw members 18 and 20. The jaw members 18 and 20 are thus brought together and the bead protrusion portion 24 forces a portion of the side wall into the bead recess 22, thus forming a bead 4.

During the same vertical motion of the actuating plate 26, but after the formation of the bead, the third members 42 undergo vertical motion, which results in vertical motion of the curl forming means 44. A channel portion 46 of curl forming means 44 is forced upwards against the pre-curl of the upper edge 14 to produce a final curl 6. A downwards force could also be applied on the container 8 from a further component disposed above the mandrel to ensure a complete final curl is formed in the channel portion.

After the bead and curl operation, the actuating plate is retracted and the sidewalls of the metal container are released.

A stop means 18 is provided on said apparatus 2 to ensure the actuating plate moves up and retracts down the spindle by a predetermined distance.

The first and second jaw members 18 and 20 are biased respectively outwardly and inwardly by spring biasing means (not shown). The actuating plate 26 can also be spring biased on spindle 28.

The first and second jaw members 18 and 20 could include any conventional sliding means for movement against the cam surfaces 36 and 38. For example, bearings, wheels, low friction sliding contacts or the like could be used.

The dimensions of the first, second and third members can be altered accordingly to provide a series of time spaced events, during the single vertical motion of the actuating plate. For example, by making the first member marginally longer than the second member, the first jaw member can be moved horizontally into position prior to movement of the second jaw member. Additionally the speed of travel of the jaw members can be altered as this is dependent on the degree of incline of the cam surfaces 36, 38.

The contact pressures of the jaw members are equal at all points on the metal container to ensure a continuous defined shape.

The positioning of the jaw members and the channel means and first, second and third members can be adjusted to accommodate containers of different sizes.

What is claimed is:

1. An apparatus for providing at least a bead on a side wall portion of a metal container, said apparatus comprising a mandrel over which said side wall portion is disposed, said mandrel having reaction members with reaction surfaces for supporting the side wall portion internally, the apparatus further comprising a plurality of forming members surrounding the mandrel having forming surfaces being substantially parallel with the reaction surfaces but separated therefrom to define a gap between said surfaces which receives said side wall portion, said reaction members and forming members being capable of displacement towards and away from one another such that the gap between the reaction surfaces and forming surfaces can effectively expand and contact, said reaction surfaces and forming surfaces being provided with complementary formations thereon to deform the side wall portion therebetween and form a bead therein, wherein the reaction members and the forming members are moved back and forth by virtue of cam means particular to each reaction member and forming member, the cam means driving the reaction members and the cam means driving the forming members both being provided on an actuating plate disposed beneath said reaction members and forming members and being capable of linear reciprocal motion parallel with the central axis of the mandrel, said linear motion in a first direction causing said reaction members and said forming members to approach one another and in a second opposite direction causing said reaction members and said forming members to recede from one another.

2. An apparatus according to claim 1 wherein the cam means comprise a plurality of pins or plates standing proud of one surface of the actuating member having inclined cam surfaces at their extremities on which cams rotationally mounted on the reaction members and forming members can travel.

3. An apparatus according to claim 1 wherein the inclination and disposition of the cam means which cause linear translation of the reaction members and those cam means which cause linear translation of the forming members are different to permit the velocity and/or acceleration of said reaction members to be predeterminedly and individually controlled.

4. An apparatus according to claim 1 wherein the reaction members and the forming members are springingly biased against the cam means.

5. An apparatus according to claim 1 wherein a bead and curl are formed on the metal container consecutively.

6. An apparatus according to claim 1 wherein the actuating plate drives curl forming means disposed around the periphery of the side wall portions of the container when disposed around the mandrel.

7. An apparatus according to claim 6 wherein the curl forming means is integrally formed with the actuating plate.

8. An apparatus according to claim 6 wherein the curl forming means is a separate component drivingly connected to the actuating plate.

9. An apparatus according to claim 6 wherein the motion of the actuating plate causes corresponding motion of the curl forming means relative to the peripheral edge of the side wall portion in a direction perpendicular to the plane containing the edge of the side wall, the orientation of said curl forming means being parallel with said plane.

10. An apparatus according to claim 9 wherein the curl forming means forms the curl as the actuating plate approaches its maximum displacement of its reciprocal motion.

11. An apparatus according to claim 9 wherein the curl forming means and/or actuating plate are provided with stop means to limit the relative motion of the side wall portion and said curl forming means and thereby limit the size of the finished curl.

12. An apparatus according to claim 1 wherein the actuating plate is slidably located on a spindle.

13. An apparatus according to claim 12 wherein the actuating plate is spring biased on the spindle.

14. A method of manufacturing a bead and curl on a side wall portion of a metal container, said method comprising the steps of:

a) disposing said side wall portion around a mandrel, b) clamping said sidewalls of said container between reaction surfaces of reaction members provided on the mandrel and forming surfaces substantially parallel with the reaction surfaces and provided on forming members suitably arranged around the reaction surfaces to define a gap of the same general shape as the cross-sectional shape of said container, said reaction surfaces and said forming surfaces having complementary formations and being capable of being displaced towards and away from one another, c) forming a bead in said sidewall portion by compressing said side wall portion between said reaction surfaces and said forming surfaces, and d) subsequently causing curl forming means to move relative to the side wall portion thereby forming a curl, the displacement of the reactions members and forming members being laterally outwardly and inwardly of the mandrel whereas the relative motion between the curl forming means and the side wall portion of the container is axially of the mandrel, wherein both motions are caused by the motion of an actuating plate translating in the same general direction as the axis of the mandrel, said actuating plate being disposed beneath the reaction and forming members and being provided with one set of cam means which contact cam surfaces provided on the reaction members to drive same radially outwardly or inwardly inside the side wall portion of the container and a further set of cam means which contact cam surfaces provided on the forming members to drive same radially towards or away from the outside of the container in order to clamp or release the side wall portion of the container respectively, said bead and curl being formed when said side wall portion is so clamped.

15. A method according to claim 14 wherein a peripheral edge of the side wall portion is initially provided with a pre-curl prior to the insertion of said portion into said apparatus.

* * * * *